US010602259B1

(12) United States Patent
Huang et al.

(10) Patent No.: US 10,602,259 B1
(45) Date of Patent: Mar. 24, 2020

(54) TWS EARPHONE WITH MULTIPLE SPEAKERS AND CROSSOVER CIRCUIT EMBEDDED THEREIN

(71) Applicant: Shenzhen Ginto E-Commerce Co., Limited, Shenzhen (CN)

(72) Inventors: Jianhua Huang, Shenzhen (CN); Yong Yang, Shenzhen (CN)

(73) Assignee: SHENZHEN GINTO E-COMMERCE CO., LIMITED, Shenzhen (CN)

( * ) Notice: Subject to any disclaimer, the term of this patent is extended or adjusted under 35 U.S.C. 154(b) by 0 days.

(21) Appl. No.: 16/221,636

(22) Filed: Dec. 17, 2018

(30) Foreign Application Priority Data

Nov. 16, 2018 (CN) ..... 2018 2 1906074 U

(51) Int. Cl.

| | |
|---|---|
| ***H04R 1/06*** | (2006.01) |
| ***H04R 1/10*** | (2006.01) |
| ***H04R 1/04*** | (2006.01) |
| ***H04R 3/14*** | (2006.01) |

(52) U.S. Cl.
CPC ..... *H04R 1/1066* (2013.01); *H04R 1/04* (2013.01); *H04R 3/14* (2013.01)

(58) Field of Classification Search
CPC ..... H04R 1/1066; H04R 3/14; H04R 1/04
See application file for complete search history.

(56) References Cited

U.S. PATENT DOCUMENTS

2002/0181729 A1* 12/2002 Smith ..... H04R 1/1075 381/381
2003/0073460 A1* 4/2003 van Pelt ..... H04M 1/6066 455/556.1
2007/0223735 A1* 9/2007 LoPresti ..... H04R 1/24 381/99
2016/0041808 A1* 2/2016 Pelland ..... G06F 3/162 381/123

* cited by examiner

*Primary Examiner* — Tuan D Nguyen

(57) ABSTRACT

A TWS earphone with multiple speakers and a crossover circuit embedded therein includes a body and a circuit unit set in the body. The circuit unit includes a Bluetooth module, a crossover circuit electrically connected to the Bluetooth module, at least two dynamic speakers or an assembly of at least one dynamic speaker and at least one balanced armature, with different response features, electrically connected to the crossover circuit, and a battery module supplying power for the circuit unit. The Bluetooth module is configured to wirelessly receive audio signals and then output the audio signals to the crossover circuit for frequency division. The crossover circuit is configured to transmit medium-low frequency audio signals after frequency division to one dynamic speaker and high frequency audio signals to the other dynamic speaker or the balanced armature.

9 Claims, 6 Drawing Sheets

TWS EARPHONE WITH MULTIPLE SPEAKERS AND CROSSOVER CIRCUIT EMBEDDED THEREIN

BACKGROUND

1. Technical Field

The present disclosure generally relates to earphones field, and especially relates to a TWS (True Wireless Stereo) earphone with multiple speakers and a crossover circuit embedded therein.

2. Description of Related Art

TWS (True Wireless Stereo) earphones have the advantages that they can save wires and are convenient to carry compared with a conventional wired earphone because audio in its left and right earbuds are transmitted by a wireless communication mode.

Conventional TWS earphones are generally lack for a frequency division function to cause them only work with a single speaker on each side thereof, which has poor sound quality and poor user experience.

SUMMARY

The technical problems to be solved: in view of the shortcomings of the related art, the present disclosure relates to a TWS earphone with multiple speakers and a crossover circuit embedded therein which can greatly improve sound quality and optimize user experience of the TWS earphone.

The technical solution adopted for solving technical problems of the present disclosure is:

a TWS earphone with multiple speakers and a crossover circuit embedded therein includes a body and a circuit unit set in the body. The circuit unit includes a Bluetooth module, a crossover circuit electrically connected to the Bluetooth module, at least two dynamic speakers with different response features electrically connected to the crossover circuit, and a battery module configured to supply power for the circuit unit. The Bluetooth module is configured to receive audio signals by a wireless mode and then output the audio signals to the crossover circuit for frequency division. The crossover circuit is configured to respectively transmit medium-low frequency audio signals and high frequency audio signals after frequency division to the at least two dynamic speakers with different response features.

Wherein the chip model of the Bluetooth module can be selected from one of AB1526, QCC3020, QCC3026, RTL8763BFR, AB1532 and BES2300.

Wherein the dynamic speaker includes a first dynamic speaker and a second dynamic speaker respectively connected to the crossover circuit.

Wherein the crossover circuit includes a first resistor, a second resistor, a third resistor and a first capacitor, a first end of the first resistor connected in parallel with a second end of the second resistor and then connected to both of a positive electrode of the audio signal output by the Bluetooth module and a positive electrode of the battery module; a negative electrode of the audio signal output by the Bluetooth module connected to a negative electrode of the battery module, a first opposite end of the first resistor connected to the third resistor and then connected to a positive electrode of the first dynamic speaker, a second opposite end of the second resistor connected to the first capacitor, a third opposite end of the third resistor connected to negative electrodes of the first and second dynamic speakers and then connected to the negative electrode of the battery module, and a fourth opposite end of the first capacitor connected to a positive electrode of the second dynamic speaker.

Wherein the crossover circuit includes a first resistor, a second resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to a positive electrode of the first dynamic speaker, a second opposite end of the second resistor connected to the first capacitor and a fourth opposite end of the first capacitor connected to a positive electrode of the second dynamic speaker, a negative electrode of the first dynamic speaker connected to a negative electrode of the second dynamic speaker and then connected to the negative electrode of the battery module.

Wherein the crossover circuit includes a first resistor, a second resistor and a third resistor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the first dynamic speaker, a second opposite end of the second resistor connected to a positive electrode of the second dynamic speaker, a third opposite end of the third resistor connected to both negative electrodes of the first and second dynamic speakers and then connected to the negative electrode of the battery module.

Wherein the circuit unit further includes a switch unit configured to control output and shutdown of power supply for the battery module and including a touch switch chip with a TTP223 model.

Wherein the circuit unit further includes an LED light electrically connected to both of the battery module and the Bluetooth module, and a microphone electrically connected to the Bluetooth module.

A TWS earphone with multiple speakers and a crossover circuit embedded therein according to another exemplary embodiment of the present disclosure includes a body and a circuit unit set in the body. The circuit unit includes a Bluetooth module, a crossover circuit electrically connected to the Bluetooth module, an assembly of at least one dynamic speaker and at least one balanced armature, with different response features, electrically connected to the crossover circuit, respectively, and a battery module configured to supply power for the circuit unit. The Bluetooth module is configured to receive audio signals by a wireless mode and then output the audio signals to the crossover circuit for frequency division. The crossover circuit is configured to transmit medium-low frequency audio signals after frequency division to the at least one dynamic speaker, and transmit high frequency audio signals after frequency division to the at least one balanced armature which has a different frequency from that of the at least one dynamic speaker.

Wherein the circuit unit includes a dynamic speaker and two balanced armatures which includes a first balanced armature and a second balanced armature. The crossover circuit is electrically connected to each of the dynamic speaker, the first balanced armature and the second balanced armature.

Wherein the crossover circuit includes a first resistor, a second resistor, a third resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the dynamic speaker, a second opposite end of the second resistor connected to the first capacitor, a third opposite end of the third resistor connected to each of a negative electrode of the dynamic speaker, a negative electrode of the first balanced armature, a negative electrode of the second balanced armature and the negative electrode of the battery module, and a fourth opposite end of the first capacitor connected to both a positive electrode of the first balanced armature and a positive electrode of the second balanced armature.

Wherein the crossover circuit includes a first resistor, a second resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to a positive electrode of the dynamic speaker, a second opposite end of the second resistor connected to the first capacitor, a negative electrode of the dynamic speaker, a negative electrode of the first balanced armature and a negative electrode of the second balanced armature connected to each other and then respectively connected to the negative electrode of the battery module, and a fourth opposite end of the first capacitor connected to both a positive electrode of the first balanced armature and a positive electrode of the second balanced armature.

Wherein the crossover circuit includes a first resistor, a second resistor and a third resistor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the dynamic speaker, a second opposite end of the second resistor connected to both a positive electrode of the first balanced armature and a positive electrode of the second balanced armature, a third opposite end of the third resistor connected to each of a negative electrode of the dynamic speaker, a negative electrode of the first balanced armature, a negative electrode of the second balanced armature and the negative electrode of the battery module.

The present disclosure provides the advantages as below.

The structure of the present disclosure is provided a crossover circuit set in the circuit unit within the TWS earphone and at least two dynamic speakers or at least one dynamic speaker and at least one balanced armature, with different response features, electrically connected to the crossover circuit, respectively. In this way, the crossover circuit can divide audio signals wirelessly received by the Bluetooth module into medium-low frequency audio signals and high frequency audio signals, which is then respectively transmitted to the two dynamic speakers or the at least one moving coil and the at least one balanced armature for playing, thereby it can greatly improve the sound quality of the TWS earphone, optimize the user's use experience and further be portable.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

Figure 1:
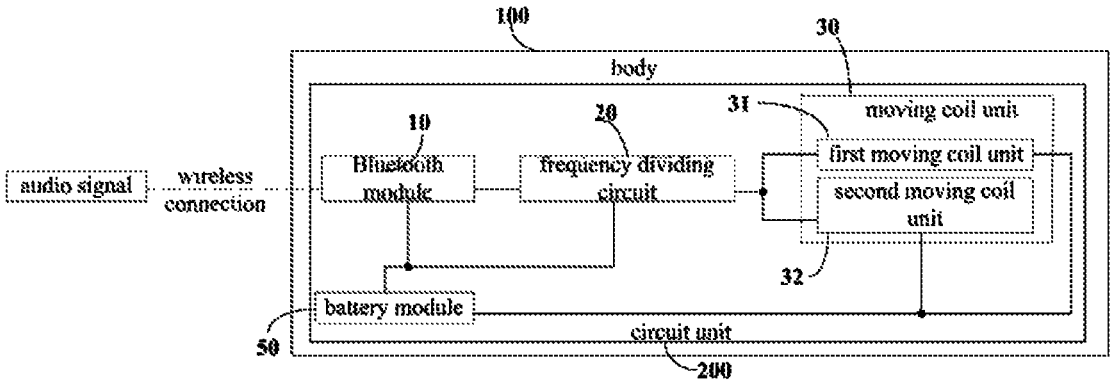
FIG. 1 is a schematic view of the TWS earphone with multiple speakers and a crossover circuit embedded therein in accordance with a first exemplary embodiment.

The element labels according to the exemplary embodiment of the present disclosure shown as below:

body 100, circuit unit 200, Bluetooth module 10, crossover circuit 20, dynamic speaker 30, positive electrode of the dynamic speaker 30*a*, negative electrode of the dynamic speaker 30*b*, first dynamic speaker 31, positive electrode of the first dynamic speaker 31*a*, negative electrode of the first dynamic speaker 31*b*, second dynamic speaker 32, positive electrode of the second dynamic speaker 32*a*, negative electrode of the second dynamic speaker 32*b*, balanced armature 40, first balanced armature 41, positive electrode of the first balanced armature 41*a*, negative electrode of the first balanced armature 41*b*, second balanced armature 42, positive electrode of the second balanced armature 42*a*, negative electrode of the second balanced armature 42*b*, battery module 50, positive electrode of the battery module 50*a*, negative electrode of the battery module 50*b*, switch unit 60, touch switch chip 61, LED light 70, microphone 80, first resistor R1, first end 1*a*, first opposite end 1*b*, second resistor R2, second end 2*a*, second opposite end 2*b*, third resistor R3, third opposite end 3*a*, first capacitor C1, fourth opposite end 4*a*, positive electrode of the audio signal TP+, negative electrode of the audio signal TP−.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. The disclosure is illustrated by way of example and not by way of limitation in the figures of the accompanying drawings, in which like reference numerals indicate similar elements.

In the description of the present disclosure, it needs to be explained that all the directional indicators (such as the terms: "upper", "below", "left", "right", "front", "back" . . . ), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

In the description of the present disclosure, except where specifically otherwise illustrated or limited, the terms "connect" and "link" used herein should be understood in a broad sense. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure.

Furthermore, in the description of the present disclosure, the terms such as "first" and "second" shown in the specification are only used to describe, but not indicated that the elements of the present disclosure is important or represented the amount of the elements. That is, the features limited by the terms of "first" and "second" may explicitly or implicitly include one or more features.

Referring to FIG. 1, the TWS earphone with multiple speakers and a crossover circuit therein in accordance with a first exemplary embodiment includes a body 100 and a circuit unit 200 set in the body.

The circuit unit 200 includes a Bluetooth module 10, a crossover circuit 20 electrically connected to the Bluetooth module 10, at least two dynamic speakers 30 with different response features electrically connected to the crossover circuit 20, and a battery module 50 configured to supply power for the circuit unit 200.

The Bluetooth module 10 is configured to receive audio signals by a wireless mode and then output the audio signal to the crossover circuit 20 for frequency division. The crossover circuit 20 is configured to respectively transmit medium-low frequency audio signals and high frequency audio signals after frequency division to the at least two dynamic speakers 30 with different response features. The Bluetooth module 10 can receive audio signals wirelessly from smart phones or other smart devices. At the same time, the Bluetooth module 10 of two TWS earphones at the left and right can be connected wirelessly for data transmission.

Figure 2:
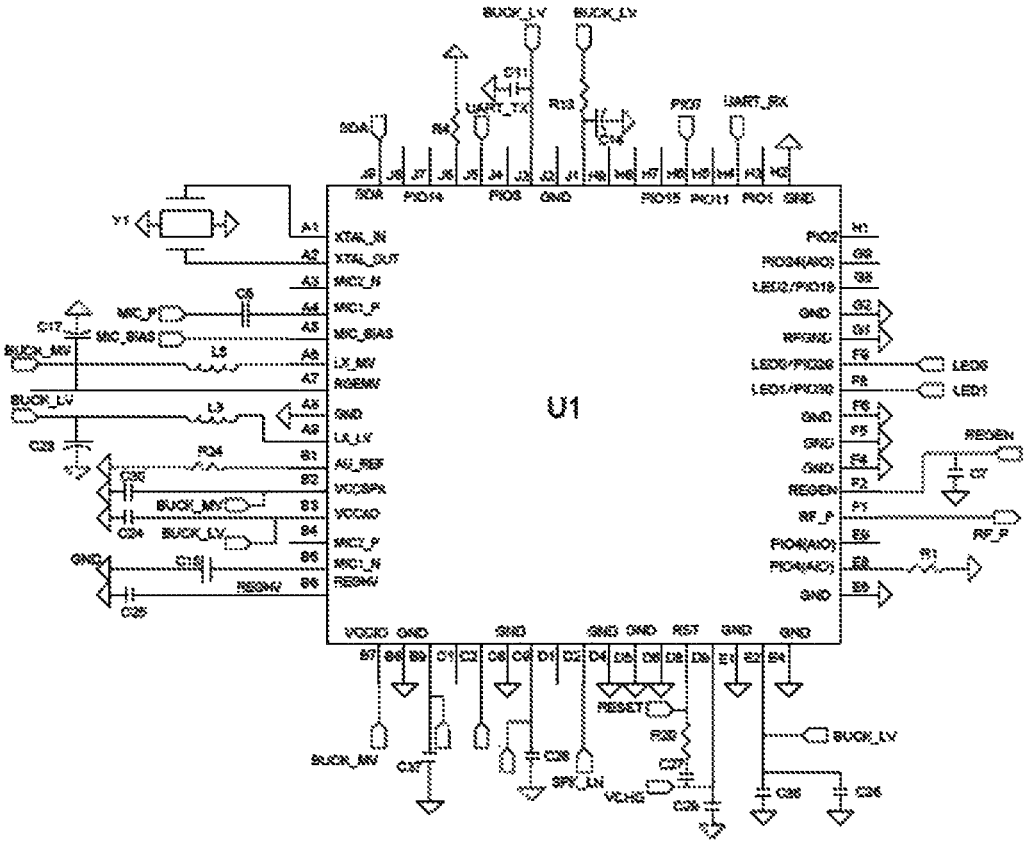
FIG. 2 is a circuit diagram of a Bluetooth module of the TWS earphone with multiple speakers and a crossover circuit embedded therein of FIG. 1.

The Bluetooth module 10 is composed of a Bluetooth chip matched with a corresponding circuit. The Bluetooth chip can connect to a Bluetooth antenna circuit to realize A2DP protocol, HFP protocol and HSP protocol. A usual Bluetooth chip can be selected from one of Qualcomm QCC30XX series, Airohal5XX series, Realtek8763 series and Bestechnic BES23 series, etc. Furthermore, an audio output end of the Bluetooth chip is also connected with an audio power amplifier circuit. Audio source can be decoded from digital signals through the Bluetooth module 10 into analog signals and then sent to the crossover circuit 20. The chip model of the Bluetooth module 10 can be specifically selected from one of AB1526, QCC3020, QCC3026, RTL8763BFR, AB1532 and BES2300. Preferably, referring to FIG. 2, the chip model of the Bluetooth module 10 of the present disclosure is AB1526 which is integrated with the baseband and radio for high-density audio applications, supported Bluetooth 4.2 with dual-mode authentication, embedded with serial flash memories, and flexibly supported for third-party software transplantation.

The crossover circuit 20 is a circuit designed to be capable of both high-pass and low-pass filtering and power attenuation according to a specific vibration unit of the earphone (multiple dynamic speakers or an assembly of a dynamic speaker and a balanced armature) and a cavity. Such circuit is configured to divide analog signals filtering into high frequency signals and medium-low frequency signals and then transmit them to the two dynamic speakers 30 with different response features, respectively.

A common diameter of the dynamic speaker 30 can be 6 mm or 10 mm. The dynamic speaker 30 is configured to receive a frequency division signal transmitted by the crossover circuit 20 and then convert it into a corresponding frequency sound wave.

Referring to FIG. 1, the dynamic speaker 30 according to the first exemplary embodiment of the present disclosure includes a first dynamic speaker 31 and a second dynamic speaker 32 respectively connected to the crossover circuit 20. The first dynamic speaker 31 and the second dynamic speaker 32 have different response features. For example, the diameter of the first dynamic speaker 31 is 6 mm and beryllium-plated material is used, while the diameter of the second dynamic speaker 32 is 10 mm and PET material is used. In this way, the vibration characteristics and acoustic frequency response of the two dynamic speakers with two different structures and materials are different. Thus, the analog audio signals divided by the crossover circuit 20 can respectively generate sound waves of two different frequencies through the first dynamic speaker 31 and the second dynamic speaker 32 of the TWS earphone, so that user can hear full frequency sound waves composed of high frequency sound wave and medium-low frequency sound wave through the TWS earphone, thereby its sound quality is greatly improved with respect to the conventional TWS earphone.

Figure 3:
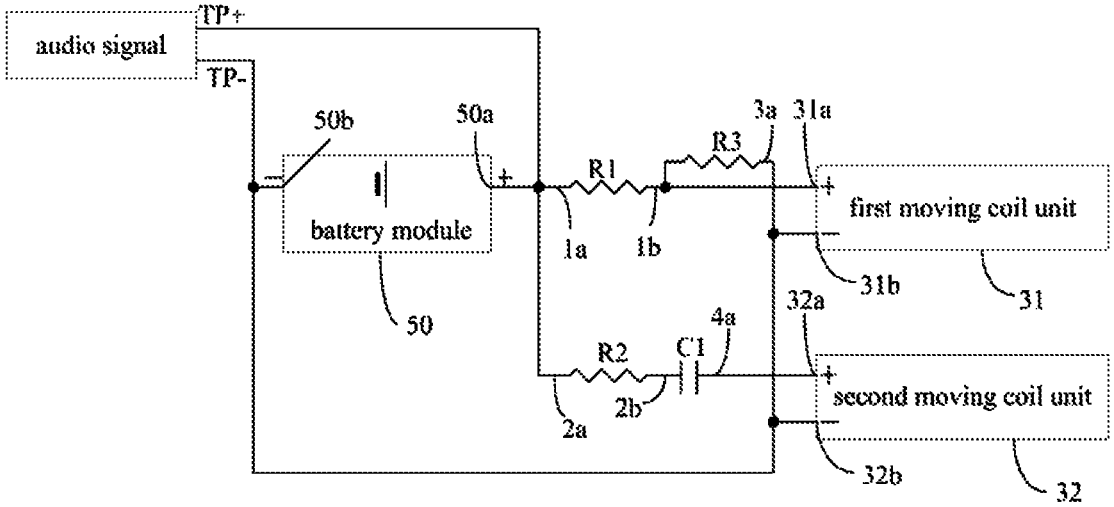
FIG. 3 is a schematic view of a crossover circuit of the TWS earphone with multiple speakers and a crossover circuit embedded therein according to an exemplary embodiment.

Specifically, referring to FIG. 3, the crossover circuit 20 according to an exemplary embodiment of the present disclosure includes a first resistor R1, a second resistor R2, a third resistor R3 and a first capacitor C1. A first end 1*a* of the first resistor R1 is connected in parallel with a second end 2*a* of the second resistor R2 and then connected to both of a positive electrode TP+ of the audio signals output by the Bluetooth module 10 and a positive electrode 50*a* of the battery module 50. A negative electrode TP− of the audio signals output by the Bluetooth module 10 is connected to a negative electrode 50*b* of the battery module 50. A first opposite end 1*b* of the first resistor R1 is connected to the third resistor R3 and then connected to a positive electrode 31*a* of the first dynamic speaker 31. A second opposite end 2*b* of the second resistor R2 is connected to the first capacitor C1, and a fourth opposite end 4*a* of the first capacitor C1 is connected to a positive electrode 32*a* of the second dynamic speaker 32. A third opposite end 3*a* of the third resistor R3 is connected to negative electrodes 31*b*, 32*b* of the first and second dynamic speakers 31, 32 and then connected to the negative electrode 50*b* of the battery module 50.

Figure 4:
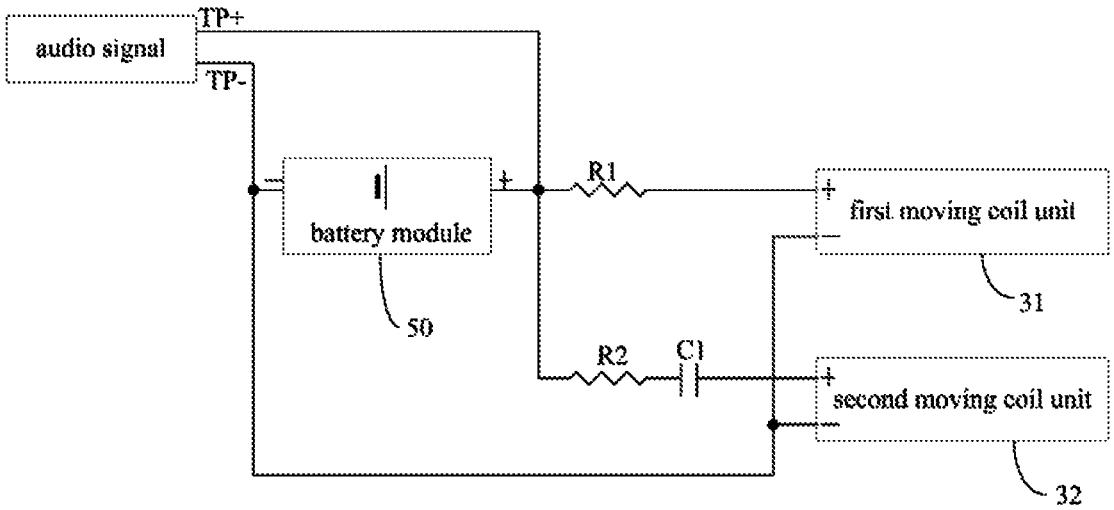
FIG. 4 is a schematic view of a crossover circuit of the TWS earphone with multiple speakers and a crossover circuit embedded therein according to the other exemplary embodiment.

Referring to FIG. 4, the crossover circuit 20 according to the other exemplary embodiment of the present disclosure includes a first resistor R1, a second resistor R2, a third resistor R3 and a first capacitor C1. A first end 1*a* of the first resistor R1 is connected in parallel with a second end 2*a* of the second resistor R2 and then connected to both of a positive electrode TP+ of the audio signals output by the Bluetooth module 10 and a positive electrode 50*a* of the battery module 50. A negative electrode TP− of the audio signals output by the Bluetooth module 10 is connected to a negative electrode 50*b* of the battery module 50. A first opposite end 1*b* of the first resistor R1 is connected to a positive electrode 31*a* of the first dynamic speaker 31. A second opposite end 2*b* of the second resistor R2 is connected to the first capacitor C1, and a fourth opposite end 4*a* of the first capacitor C1 is connected to a positive electrode 32*a* of the second dynamic speaker 32. A negative electrode 31*b* of the first dynamic speaker 31 is connected to a negative electrode 32*b* of the second dynamic speaker 32 and then connected to the negative electrode 50*b* of the battery module 50.

Figure 5:
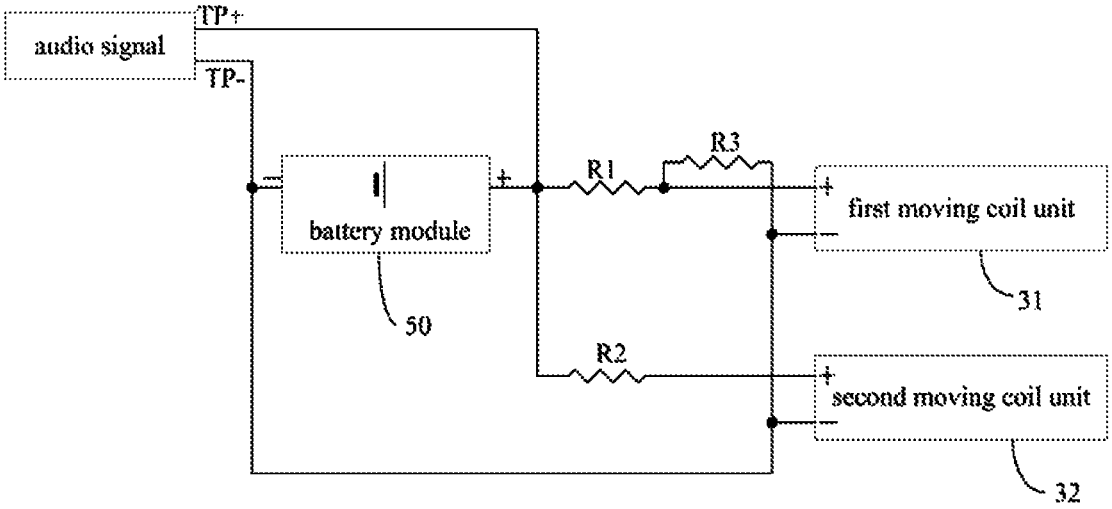
FIG. 5 is a schematic view of a crossover circuit of the TWS earphone with multiple speakers and a crossover circuit embedded therein according to another exemplary embodiment.

Referring to FIG. 5, the crossover circuit 20 according to another exemplary embodiment of the present disclosure includes a first resistor R1, a second resistor R2, a third resistor R3 and a first capacitor C1. A first end 1*a* of the first resistor R1 is connected in parallel with a second end 2*a* of the second resistor R2 and then connected to both of a positive electrode TP+ of the audio signals output by the Bluetooth module 10 and a positive electrode 50*a* of the battery module 50. A negative electrode TP− of the audio signals output by the Bluetooth module 10 is connected to a negative electrode 50*b* of the battery module 50. A first opposite end 1*b* of the first resistor R1 is connected to the third resistor R3 and then connected to a positive electrode 31*a* of the first dynamic speaker 31. A second opposite end 2*b* of the second resistor R2 is connected to a positive electrode 32*a* of the second dynamic speaker 32, and a third opposite end 3*a* of the third resistor R3 is connected to both negative electrodes 31*b*, 32*b* of the first and second dynamic speakers 31, 32 and then connected to the negative electrode 50*b* of the battery module 50.

The structure of the above frequency division circuits set in the TWS earphone is simple, low-cost and easy to promote.

Figure 6:
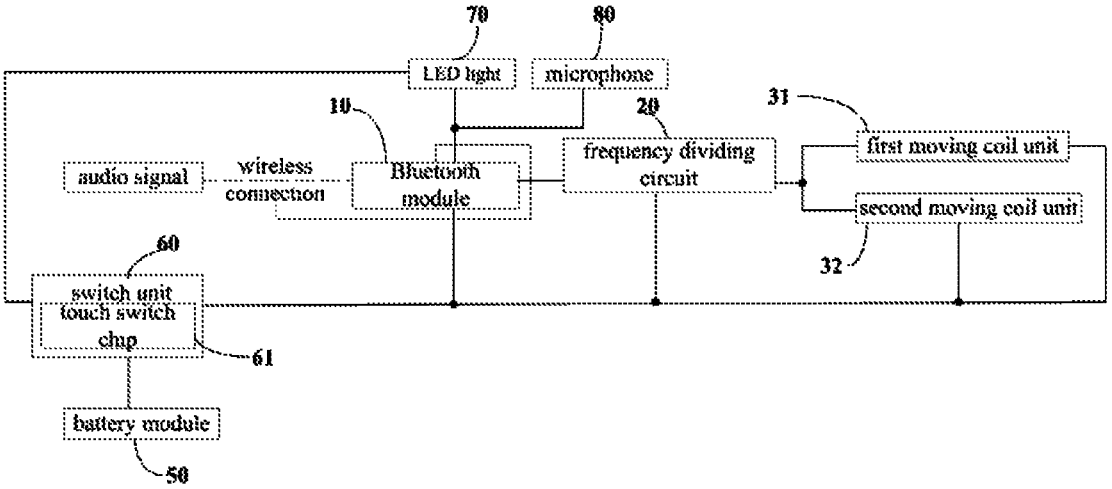
FIG. 6 is a schematic view of a switch unit, an LED light and a microphone connected in a circuit unit of the TWS earphone with multiple speakers and a crossover circuit embedded therein of FIG. 1.

Preferably, referring to FIG. 6, the circuit unit 200 further includes a switch unit 60 configured to flexibly and conveniently control output and shutdown of power supply for the battery module 50 and including a touch switch chip 61 with a TTP223 model.

The circuit unit 200 further includes an LED light 70 electrically connected to both of the battery module 50 and the Bluetooth module 10, and a microphone 80 electrically connected to the Bluetooth module 10. The LED light 70 is set to power up the TWS earphone and indicate its working status, and the microphone 80 is set to allow the TWS earphone to speak directly by Bluetooth.

Figure 7:
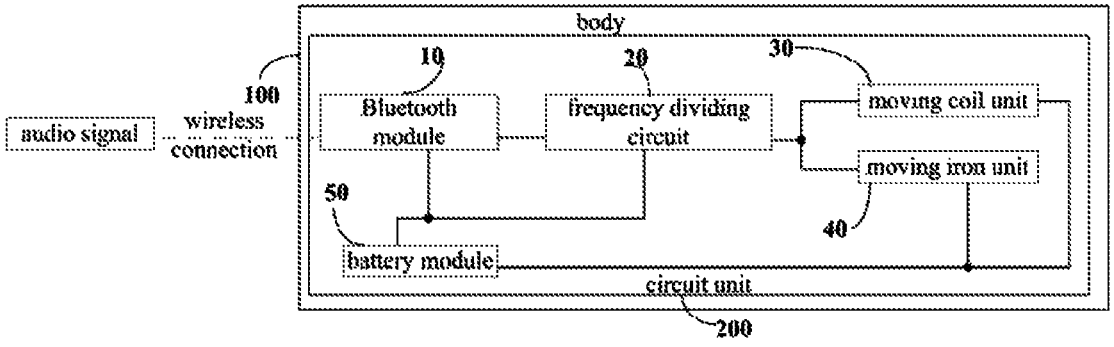
FIG. 7 is a schematic view of the TWS earphone with multiple speakers and a crossover circuit embedded therein in accordance with a second exemplary embodiment.

Referring to FIG. 7, the TWS earphone with multiple speakers and a crossover circuit embedded therein in accordance with a second exemplary embodiment includes a body 100 and a circuit unit 200 set in the body 100.

The circuit unit 200 includes a Bluetooth module 10, a crossover circuit 20 electrically connected to the Bluetooth module 10, an assembly of at least one dynamic speaker 30 and at least one balanced armature 40, with different response features, electrically connected to the crossover circuit 20, respectively, and a battery module 50 configured to supply power for the circuit unit 200.

The Bluetooth module 10 is configured to receive audio signals by a wireless mode and then output the audio signal to the crossover circuit 20 for frequency division. The crossover circuit 20 is configured to transmit medium-low frequency audio signals after frequency division to the at least one dynamic speaker 30, and transmit high frequency audio signals after frequency division to the at least one balanced armature 40 which has a different frequency from that of the at least one dynamic speaker 30.

The dynamic speaker 30 and the balanced armature 40 of the second exemplary embodiment of the present disclosure can be combined together via their multiple units. For example, a dynamic speaker 30 is combined with a balanced armature 40, a dynamic speaker 30 is combined with two balanced armatures 40, or two dynamic speakers 30 are combined with two balanced armatures 40, etc.

Figure 8:
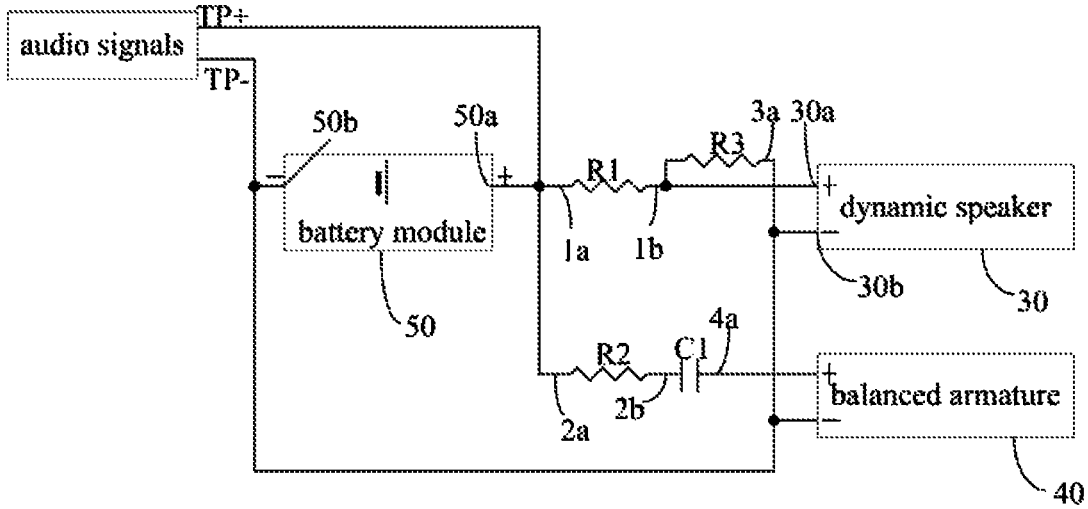
FIG. 8 is a schematic view of the frequency circuit of FIG. 3 connected to a dynamic speaker and a balanced armature of the TWS earphone with multiple speakers and a crossover circuit embedded therein of FIG. 1.
Figure 9:
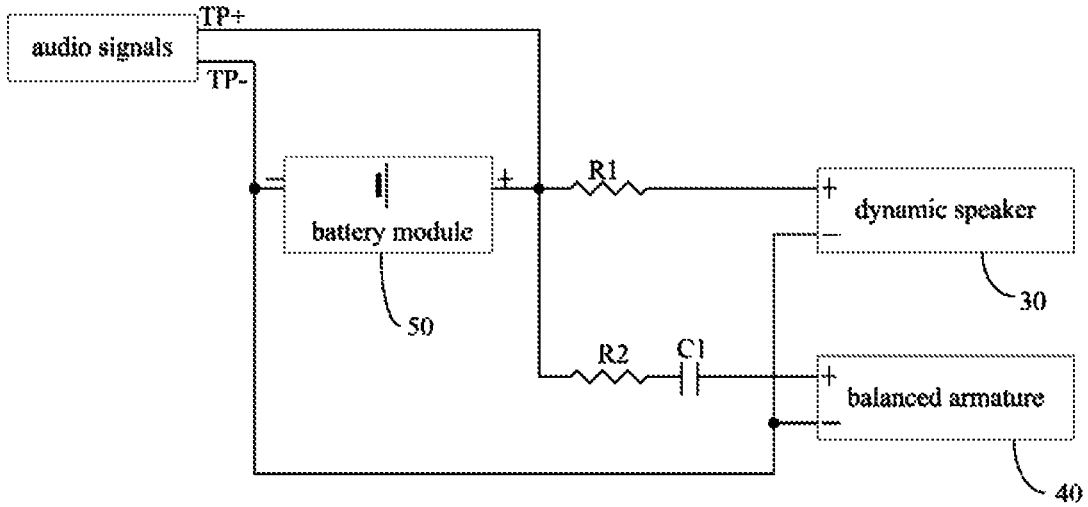
FIG. 9 is a schematic view of the frequency circuit of FIG. 4 connected to a dynamic speaker and a balanced armature of the TWS earphone with multiple speakers and a crossover circuit embedded therein of FIG. 1.
Figure 10:
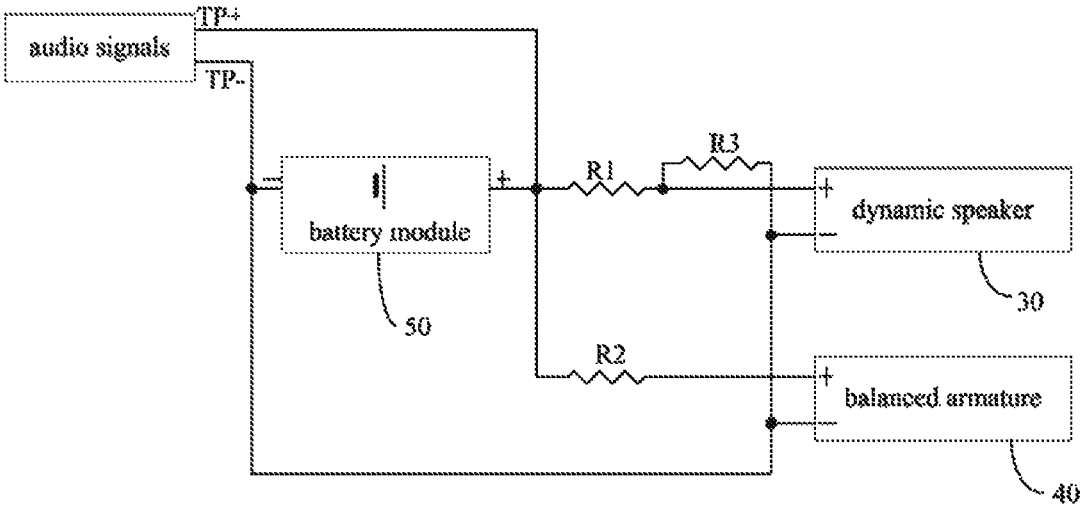
FIG. 10 is a schematic view of the frequency circuit of FIG. 5 connected to a dynamic speaker and a balanced armature of the TWS earphone with multiple speakers and a crossover circuit embedded therein of FIG. 1

Referring to FIGS. 8-10, the circuit unit 200 according to a second exemplary embodiment of the present disclosure includes a dynamic speaker 30 and a balanced armature 40. The difference between the exemplary embodiment and the first exemplary embodiment is that the second dynamic speaker 32 of the first embodiment is replaced by the moving iron element 40, and the other structures in the two embodiments are same.

In the exemplary embodiment of the present disclosure, the dynamic speaker 30 is a bass dynamic speaker with its usual diameter being 6 mm or 10 mm, and is configured to receive medium-low frequency analog signals and convert them into medium-low frequency sound waves. The balanced armature 40 is a high-pitched balanced armature and configured to receive high-frequency analog signals and convert them into high-frequency sound waves. The crossover circuit 20 is configured to divide the audio signals received by the Bluetooth module 10 into medium-low frequency audio signals and high-frequency audio signals, and then send the medium-low frequency audio signals to the dynamic speaker 30 to generate medium-low frequency sound waves, and send the high-frequency audio signals to the balanced armature 40 to generate high-frequency sound waves. Finally, the medium-low frequency sound waves and the high-frequency sound waves are respectively played via the dynamic speaker 30 and the balanced armature 40, thereby it can greatly improve the sound quality of the TWS earphone and optimize the user's use experience.

Figure 11:
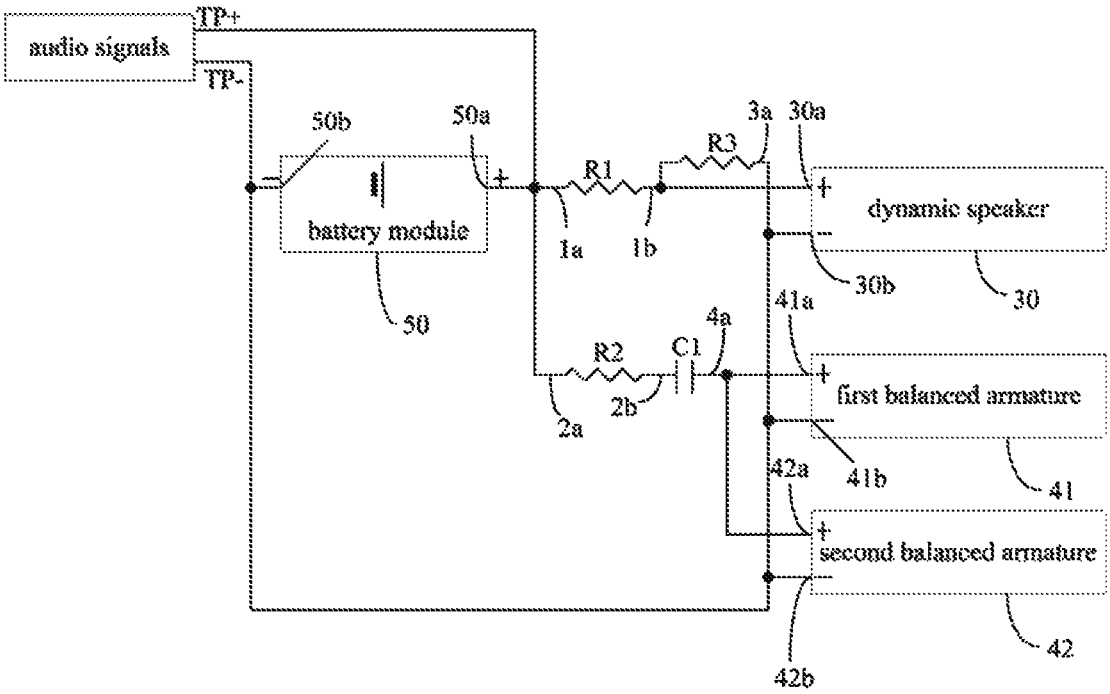
FIG. 11 is a schematic view of the frequency circuit of FIG. 3 connected to a dynamic speaker, a first balanced armature and a second balanced armature of the TWS earphone with multiple speakers and a crossover circuit embedded therein of FIG. 1.
Figure 12:
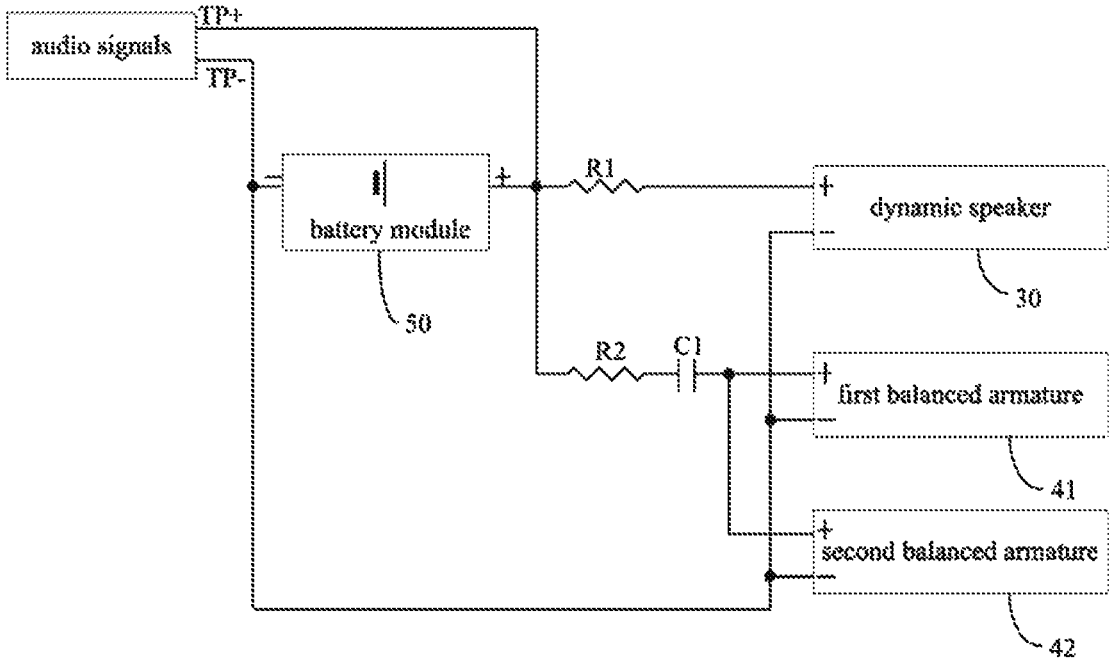
FIG. 12 is a schematic view of the frequency circuit of FIG. 4 connected to a dynamic speaker, a first balanced armature and a second balanced armature of the TWS earphone with multiple speakers and a crossover circuit embedded therein of FIG. 1.
Figure 13:
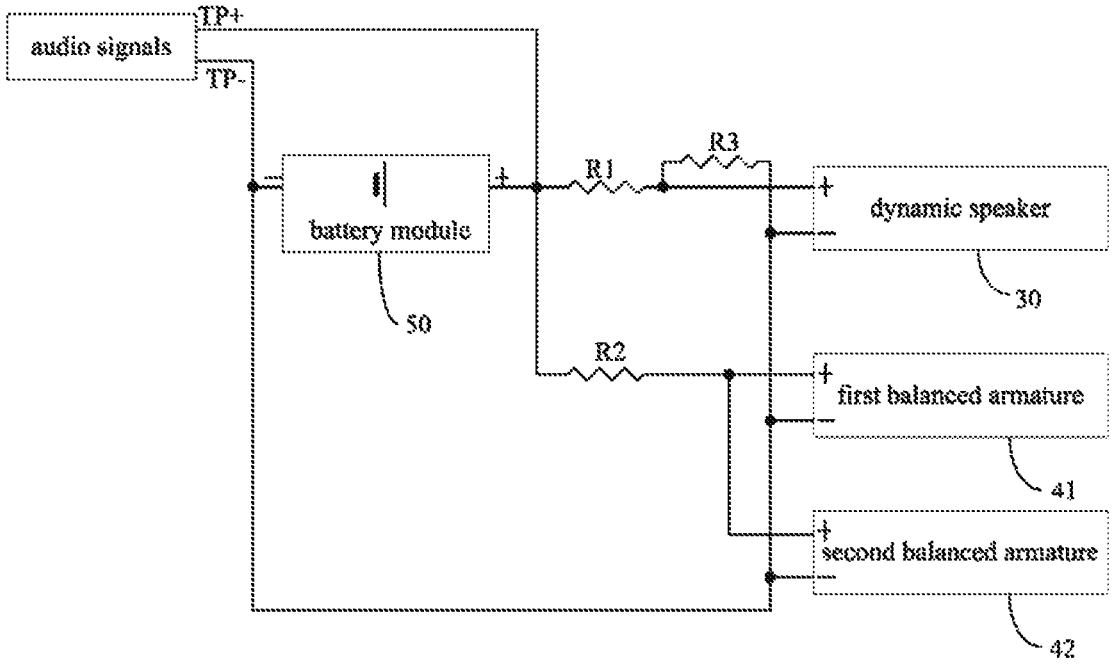
FIG. 13 is a schematic view of the frequency circuit of FIG. 5 connected to a dynamic speaker, a first balanced armature and a second balanced armature of the TWS earphone with multiple speakers and a crossover circuit embedded therein of FIG. 1.

Furthermore, referring to FIGS. 11-13, the circuit unit 200 of the exemplary embodiment of the present disclosure includes a dynamic speaker 30 and two balanced armatures 40 which are named as a first balanced armature 41 and a second balanced armature 42. The crossover circuit 20 is connected to each of the dynamic speaker 30, the first balanced armature 41 and the second balanced armature 42. In this way, the high frequency part of the audio signals received by the Bluetooth module 10 can be more carefully divided into two kinds of high frequency audio signals. And then, two kinds of high frequency sound waves can be generated by the first balanced armature 41 and the second balanced armature 42 respectively for playing, which can further improve the sound quality of the TWS earphone.

Referring to FIG. 11, the crossover circuit 20 includes a first resistor R1, a second resistor R2, a third resistor R3 and a first capacitor C1. A first end 1*a* of the first resistor R1 is connected in parallel with a second end 2*a* of the second resistor R2 and then connected to both of a positive electrode TP+ of the audio signals output by the Bluetooth module 10 and a positive electrode 50*a* of the battery module 50. A negative electrode TP− of the audio signals output by the Bluetooth module 10 is connected to a negative electrode 50*b* of the battery module 50. A first opposite end 1*b* of the first resistor R1 is connected to the third resistor R3 and then connected to a positive electrode 30*a* of the dynamic speaker 30, and a second opposite end 1*b* of the second resistor R2 is connected to the first capacitor C1 and a fourth opposite end 4*a* of the first capacitor C1 is connected to both a positive electrode 41*a* of the first balanced armature 41 and a positive electrode 42*a* of the second balanced armature 42. A third opposite end 3*a* of the third resistor C1 is connected to each of a negative electrode 30*b* of the dynamic speaker 30, a negative electrode 41*b* of the first balanced armature 41, a negative electrode 42*b* of the second balanced armature 42 and the negative electrode 50*b* of the battery module 50.

Referring to FIG. 12, the crossover circuit 20 includes a first resistor R1, a second resistor R2 and a first capacitor C1. A first end 1*a* of the first resistor R1 is connected in parallel with a second end 2*a* of the second resistor R2 and then connected to both of a positive electrode TP+ of the audio signals output by the Bluetooth module 10 and a positive electrode 50*a* of the battery module 50. A negative electrode TP− of the audio signals output by the Bluetooth module 10 is connected to a negative electrode 50*b* of the battery module 50. A first opposite end 1*b* of the first resistor R1 is connected to a positive electrode 30*a* of the dynamic speaker 30. A second opposite end 2*b* of the second resistor R2 is connected to the first capacitor C1, and a fourth opposite end 4*a* of the first capacitor C1 is connected to both a positive electrode 41*a* of the first balanced armature 41 and a positive electrode 42*a* of the second balanced armature 42. A negative electrode 30*b* of the dynamic speaker 30, a negative electrode 41*b* of the first balanced armature 41 and a negative electrode 42*b* of the second balanced armature 42 are connected to each other and then respectively connected to the negative electrode 50*b* of the battery module 50.

Referring to FIG. 13, the crossover circuit 20 includes a first resistor R1, a second resistor R2 and a third resistor R3. A first end 1*a* of the first resistor R1 is connected in parallel with a second end 2*a* of the second resistor R2 and then connected to both of a positive electrode TP+ of the audio signals output by the Bluetooth module 10 and a positive electrode 50*a* of the battery module 50. A negative electrode TP− of the audio signals output by the Bluetooth module 10 is connected to a negative electrode 50*b* of the battery module 50. A first opposite end 1*b* of the first resistor R1 is connected to the third resistor R3 and then connected to a positive electrode 30*a* of the dynamic speaker 30. A second opposite end 1*b* of the second resistor R2 is connected to both a positive electrode 41*a* of the first balanced armature 41 and a positive electrode 42*a* of the second balanced armature 42. A third opposite end 3*a* of the third resistor R3 is connected to each of a negative electrode 30*b* of the dynamic speaker 30, a negative electrode 41*b* of the first balanced armature 41, a negative electrode 42*b* of the second balanced armature 42 and the negative electrode 50*b* of the battery module 50.

The structure of the present disclosure is provided a crossover circuit 20 set in the circuit unit 200 within the present TWS earphone and at least two dynamic speakers 30 or at least one dynamic speaker 30 and at least one balanced armature 40, with different response features, electrically connected to the crossover circuit 20, respectively. In this way, the crossover circuit 20 can divide audio signals wirelessly received by the Bluetooth module 10 into medium-low frequency audio signals and high frequency audio signals, which is then respectively transmitted to the two dynamic speakers 30 or the at least one moving coil 30 and the at least one balanced armature 40 for playing, thereby it can greatly improve the sound quality of the TWS earphone, optimize the user's use experience and further be portable.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. TWS earphone with multiple speakers and a crossover circuit embedded therein comprising a body and a circuit unit set in the body, the circuit unit comprising:

a Bluetooth module configured to receive audio signals by a wireless mode;

a crossover circuit electrically connected to the Bluetooth module;

at least two dynamic speakers with different response features electrically connected to the crossover circuit; and a battery module configured to supply power for the circuit unit; and wherein the Bluetooth module is further configured to output the audio signals to the crossover circuit for frequency division; and the crossover circuit is configured to respectively transmit medium-low frequency audio signals and high frequency audio signals after frequency division to the at least two dynamic speakers with different response features;

the dynamic speaker comprising a first dynamic speaker and a second dynamic speaker respectively connected to the crossover circuit; and wherein the crossover circuit comprises a first resistor, a second resistor, a third resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the first dynamic speaker, a second opposite end of the second resistor connected to the first capacitor, a third opposite end of the third resistor connected to negative electrodes of the first and second dynamic speakers and then connected to the negative electrode of the battery module, and a fourth opposite end of the first capacitor connected to a positive electrode of the second dynamic speaker.

2. The TWS earphone as claimed in claim 1, wherein the chip model of the Bluetooth module can be selected from one of AB1526, QCC3020, QCC3026, RTL8763BFR, AB1532 and BES2300.

3. The TWS earphone as claimed in claim 1, wherein the crossover circuit comprises a first resistor, a second resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to a positive electrode of the first dynamic speaker, a second opposite end of the second resistor connected to the first capacitor and a fourth opposite end of the first capacitor connected to a positive electrode of the second dynamic speaker, a negative electrode of the first dynamic speaker connected to a negative electrode of the second dynamic speaker and then connected to the negative electrode of the battery module.

4. The TWS earphone as claimed in claim 1, wherein the crossover circuit comprises a first resistor, a second resistor and a third resistor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the first dynamic speaker, a second opposite end of the second resistor connected to a positive electrode of the second dynamic speaker, a third opposite end of the third resistor connected to both negative electrodes of the first and second dynamic speakers and then connected to the negative electrode of the battery module.

5. The TWS earphone as claimed in claim 1, wherein the circuit unit further comprises a switch unit configured to control output and shutdown of power supply for the battery module and comprising a touch switch chip with a TTP223 model.

6. The TWS earphone as claimed in claim 1, wherein the circuit unit further comprises an LED light electrically connected to both of the battery module and the Bluetooth module, and a microphone electrically connected to the Bluetooth module.

7. A TWS earphone with multiple speakers and a crossover circuit embedded therein comprising a body and a circuit unit set in the body, the circuit unit comprising:

a Bluetooth module configured to receive audio signals by a wireless mode;

a crossover circuit electrically connected to the Bluetooth module;

an assembly of at least one dynamic speaker and at least one balanced armature, with different response features, electrically connected to the crossover circuit, respectively; and a battery module configured to supply power for the circuit unit; and wherein the Bluetooth module is further configured to output the audio signals to the crossover circuit for frequency division; and the crossover circuit is configured to transmit medium-low frequency audio signals after frequency division to the at least one dynamic speaker, and transmit high frequency audio signals after frequency division to the at least one balanced armature which has a different frequency from that of the at least one dynamic speaker;

the circuit unit comprising a dynamic speaker and two balanced armatures which comprises a first balanced armature and a second balanced armature, the crossover circuit is electrically connected to each of the dynamic speaker, the first and second balanced armatures; and wherein the crossover circuit comprises a first resistor, a second resistor, a third resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the dynamic speaker, a second opposite end of the second resistor connected to the first capacitor, a third opposite end of the third resistor connected to each of a negative electrode of the dynamic speaker, a negative electrode of the first balanced armature, a negative electrode of the second balanced armature and the negative electrode of the battery module, and a fourth opposite end of the first capacitor connected to both a positive electrode of the first balanced armature and a positive electrode of the second balanced armature.

8. The TWS earphone as claimed in claim 7, wherein the crossover circuit comprises a first resistor, a second resistor and a first capacitor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to a positive electrode of the dynamic speaker, a second opposite end of the second resistor connected to the first capacitor, a negative electrode of the dynamic speaker, a negative electrode of the first balanced armature and a negative electrode of the second balanced armature connected to each other and then respectively connected to the negative electrode of the battery module, and a fourth opposite end of the first capacitor connected to both a positive electrode of the first balanced armature and a positive electrode of the second balanced armature.

9. The TWS earphone as claimed in claim 7, wherein the crossover circuit comprises a first resistor, a second resistor and a third resistor, a first end of the first resistor connected in parallel with a second end of the second resistor and then connected to both of a positive electrode of the audio signals output by the Bluetooth module and a positive electrode of the battery module; a negative electrode of the audio signals output by the Bluetooth module connected to a negative electrode of the battery module, a first opposite end of the first resistor connected to the third resistor and then connected to a positive electrode of the dynamic speaker, a second opposite end of the second resistor connected to both a positive electrode of the first balanced armature and a positive electrode of the second balanced armature, a third opposite end of the third resistor connected to each of a negative electrode of the dynamic speaker, a negative electrode of the first balanced armature, a negative electrode of the second balanced armature and the negative electrode of the battery module.

* * * * *